US005542229A

United States Patent [19]

Saito et al.

[11] Patent Number: 5,542,229

[45] Date of Patent: Aug. 6, 1996

[54] CONCRETE POLE AND METHOD OF REINFORCING SAME

[75] Inventors: Makoto Saito; Yoshinori Tanaka, both of Saitama-ken, Japan

[73] Assignee: Tonen Corporation, Japan

[21] Appl. No.: 241,082

[22] Filed: May 11, 1994

[30] Foreign Application Priority Data

May 14, 1993 [JP] Japan ..... 5-136603

[51] Int. Cl.[6] ..... E04C 3/34

[52] U.S. Cl. ..... 52/721.5; 52/745.17; 52/731.2

[58] Field of Search ..... 52/728, 731.2, 52/745.17, 722, 723, 725, 727, 249

[56] References Cited

U.S. PATENT DOCUMENTS

| | | | |
|---|---|---|---|
| 4,244,156 | 1/1981 | Watts, Jr. | 52/728 X |
| 4,694,622 | 9/1987 | Richard . | |
| 4,786,341 | 11/1988 | Kobatake et al. | 156/71 |
| 5,043,033 | 8/1991 | Fyfe | 52/725 X |
| 5,138,806 | 8/1992 | Marx et al. | 52/728 X |
| 5,175,973 | 1/1993 | Owen et al. . | |
| 5,218,810 | 6/1993 | Isley, Jr. | 52/725 |

FOREIGN PATENT DOCUMENTS

| | | | |
|---|---|---|---|
| 172093 | 2/1986 | European Pat. Off. . | |
| 0173446 | 3/1986 | European Pat. Off. . | |
| 262818 | 4/1988 | European Pat. Off. . | |
| 0572243 | 12/1993 | European Pat. Off. . | |
| 3506677 | 8/1986 | Germany . | |
| 8634422 | 4/1987 | Germany . | |
| 403224966 | 10/1991 | Japan | 52/722 |
| 405141064 | 6/1993 | Japan | 52/722 |
| WO89/00917 | 3/1986 | WIPO . | |

*Primary Examiner*—Carl D. Friedman
*Assistant Examiner*—Yvonne Horton-Richardson
*Attorney, Agent, or Firm*—Seidel, Gonda, Lavorgna & Monaco

[57] ABSTRACT

A simple reinforcement for concrete pole improving the elasticity of the pole is provided. A reinforcing layer of a fiber-reinforced composite material is applied to a portion of the outer circumference of the concrete pole 9 that comprises reinforced concrete. The reinforcing layer 11 covers a depth of at least 30 cm and a height of at least 100 cm relative to the ground level when the concrete pole 9 is placed in the ground. Reinforcing fibers 4 of the reinforcing layer 11 are oriented in the axial direction of the reinforced concrete. The total cross-sectional area ($S_R$) and modulus of elasticity ($E_R$) of the reinforcing fibers 4 of the reinforcing layer 11 satisfy the following relational formula relative to the total cross-sectional area ($S_S$) and modulus of elasticity ($E_S$) of the axial reinforcing bar of the reinforced concrete:

$$0.06<E_R \cdot S_R/E_S \cdot S_S<3.0.$$

11 Claims, 4 Drawing Sheets

CONCRETE POLE AND METHOD OF REINFORCING SAME

BACKGROUND OF THE INVENTION

1. Field of the Invention

The present invention relates to a concrete pole such as an electric pole, and more particularly, to a concrete pole having elasticity improved by reinforcement.

2. Prior Art

Concrete poles are widely used for many electric poles including those for power distribution in urban areas, and those for power supply for electric trains. In general, a concrete pole is formed into a hollow cylindrical structure made of reinforced concrete by using a cage of reinforcing bars formed into a substantially cylindrical shape and placing concrete by centrifugal casting in and outside this cage.

When an automobile collides with a concrete pole on the road, the concrete pole deflects once and then resumes its original vertical posture by elasticity. When the impact is strong and results in a large deflection, however, the reinforcing bars in the interior are plastically deformed with an elongation of only 0.2%. The concrete pole can not resume the original posture, remaining as deformed.

The deformed concrete pole thus forms a traffic hindrance, and poses a danger.

Under such circumstances as described above, there is a demand for a concrete pole having an improved elasticity, which, even after occurrence of such a large deflection as to cause plastic deformation of reinforcing bars therein, can resume the original vertical posture, and which does not form a traffic hindrance or a danger for cars and electric trains. A concrete pole provided with such properties has not as yet been proposed.

SUMMARY OF THE INVENTION

An object of the present invention is therefore to provide a concrete pole having an elasticity improved by reinforcement of a simple construction, and a method of reinforcing same.

The above-mentioned object is achieved by the concrete pole and the method of reinforcing the same according to the present invention. In summary, the present invention provides a concrete pole which comprises reinforced concrete of a substantially cylindrical shape having reinforcing bars, wherein part of the outer circumference of said concrete pole is reinforced by a reinforcing layer of a fiber-reinforced composite material which is composed of reinforcing fibers and a thermosetting resin impregnated in the reinforcing fibers; said reinforcing layer covers a depth of at least 30 cm and a height of at least 100 cm relative to the ground level upon burying of said concrete pole; reinforcing fibers of said reinforcing layer are oriented in the axial direction of said reinforced concrete; and the total cross-sectional area ($S_R$) and modulus of elasticity ($E_R$) of the reinforcing fiber of said reinforcing layer satisfy the following relational formula relative to the total cross-sectional area ($S_S$) and modulus of elasticity ($E_S$) of the reinforcing bar in the axial direction of said reinforced concrete:

$$0.06<E_R \cdot S_R/E_S \cdot S_S<3.0$$

According to another embodiment of the present invention, there is provided a method of reinforcing a concrete pole by providing a reinforcing layer of a fiber reinforced composite resin material, which is composed of reinforcing fibers and a thermosetting resin impregnated in the reinforcing fibers, on part of the outer circumference of a concrete pole comprising reinforced concrete of a substantially cylindrical shape having reinforcing bars, wherein said reinforcing layer covers a depth of at least 30 cm and a height of at least 100 cm relative to the ground level upon burying of said concrete pole; the reinforcing fibers of said reinforcing layer are oriented in the axial direction of said reinforced concrete; and the total cross-sectional area ($S_R$) and modulus of elasticity ($E_R$) of the reinforcing fiber of said reinforcing layer satisfy the following relational formula relative to the total cross-sectional area ($S_S$) and modulus of elasticity ($E_S$) of the reinforcing bar in the axial direction of said reinforced concrete:

$$0.06<E_R \cdot S_R/E_S \cdot S_S<3.0$$

DETAILED DESCRIPTION OF THE PREFERRED EMBODIMENTS

Figure 1:
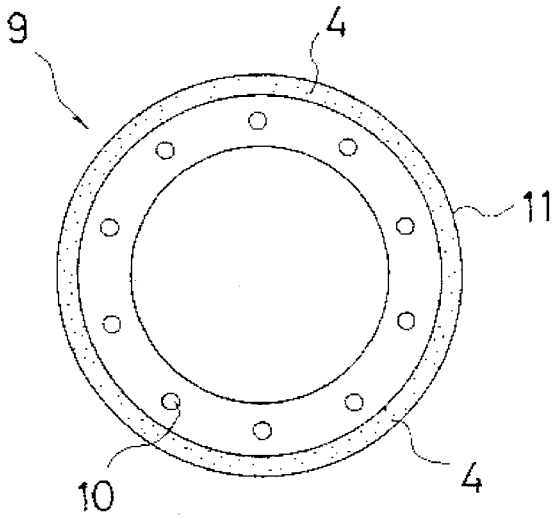
FIG. 1 is a cross-sectional view illustrating an embodiment of the concrete pole of the present invention.
Figure 2:
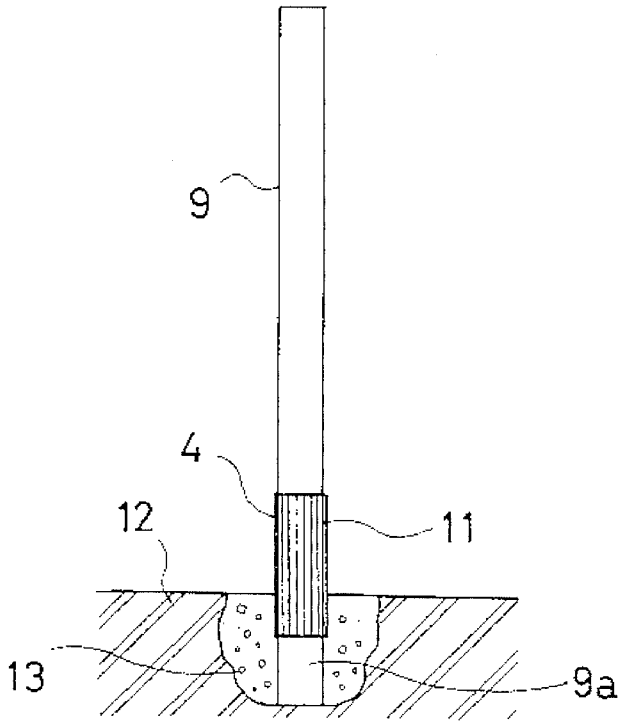
FIG. 2 is a front view illustrating the same embodiment as above.
Figure 3:
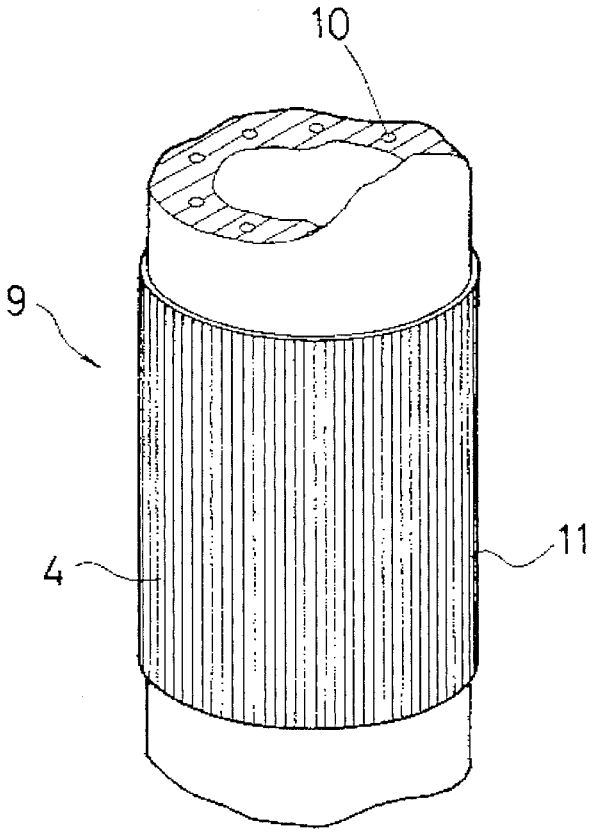
FIG. 3 is a perspective view illustrating a partially enlarged reinforcing layer provided on the concrete pole in the same embodiment.

FIG. 1 is a cross-sectional view illustrating an embodiment of the concrete pole of the present invention; FIG. 2 is a front view of the concrete pole of the present invention; and FIG. 3 is a perspective view illustrating a partially enlarged reinforcing layer provided on the concrete pole shown in FIGS. 1 and 2.

As shown in FIGS. 1 and 2, a concrete pole 9 is formed as a hollow cylinder made of reinforced concrete formed by placing concrete by centrifugal casting in and outside a cage of reinforcing bars 10 formed in a substantially cylindrical shape. The concrete pole 9 is installed vertically on the ground level with a lower portion thereof buried into the ground 12. When installing the concrete pole 9, concrete 13 is placed around the buried portion 9*a* buried in the ground 12 of the concrete pole 9 to accomplish hardening by means of concrete 13.

In this embodiment, the concrete pole 9 represents an electric pole having a straight cylindrical shape, which has, for example, a length of 10 m, an outside diameter of 35 cm and a buried portion 9*a* of 170 cm.

According to the present invention, the concrete pole 9 is provided, around upper and lower portions with the ground level of the ground 12 in between, with a reinforcing layer 11 made of a fiber-reinforced composite resin material in which reinforcing fibers 4 are oriented in the axial direction of the concrete pole 9.

The present inventors carried out extensive studies to develop a high-elasticity concrete pole. The findings obtained as a result teach that, while a concrete pole 9 comprising reinforced concrete alone loses elasticity with an elongation of about 0.15%, carbon fiber, for example, shows such a high elasticity as to serve as an elastic body with an elongation of up to about 1.5%. Therefore, it is possible to improve the elasticity of the concrete pole 9 by reinforcing it with a fiber-reinforced composite material containing carbon fiber. Even when such a large deflection causing plastic deformation of the reinforcing bars 10 in the interior of the concrete pole 9 occurs, the fiber-reinforced composite material enables the concrete pole 9 to resume the original vertical posture through elasticity.

In the present invention, a reinforcing layer 11 made of a fiber-reinforced composite material using high-elasticity reinforcing fibers 4, such as carbon fiber, is provided around portions above and below the ground level of the concrete pole 9, aligning the orientation of the reinforcing fibers with the axial direction of the concrete pole 9.

For the purpose of providing the concrete pole 9 with the reinforcing layer 11 of the fiber-reinforced composite material as described above, it is sufficient to use a unidirectional reinforcing fiber sheet as described below.

Figure 5:
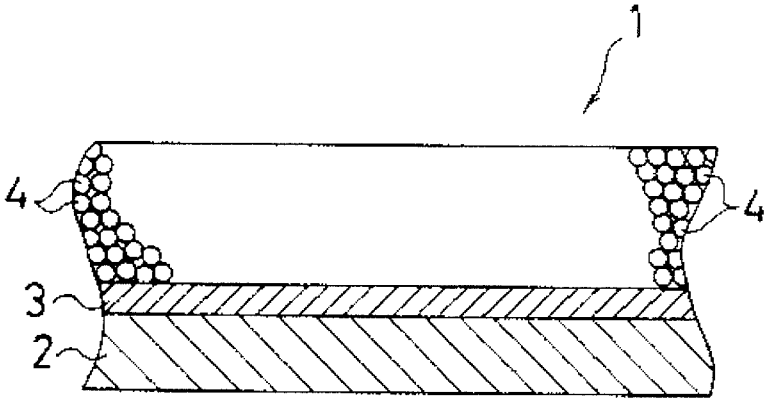
FIG. 5 is a sectional view illustrating a unidirectional reinforcing fiber sheet used for reinforcing the concrete pole of the present invention.

FIG. 5 is a sectional view illustrating a typical unidirectional reinforcing fiber sheet 1 used for the application of the reinforcing layer 11 of the fiber-reinforced composite material in the present invention. This unidirectional reinforcing sheet 1 is formed by providing an adhesive layer 3 on a substrate sheet 2, and arranging reinforcing fibers 4 in one direction through the adhesive layer 3 on the sheet 2. Details of the reinforcing fiber sheet 1 will be described below.

As shown in FIG. 3, the reinforcing layer 11 of the fiber-reinforced composite material can be provided on the concrete pole 9 by winding the reinforcing fiber sheet 1 around the surface of prescribed portions of the concrete pole 9 so that the orientation of the reinforcing fibers 4 of the reinforcing fiber sheet 1 is aligned with the axial direction of the concrete pole 9, curing a thermosetting resin impregnated into the reinforcing fibers 4 before or after winding, and thus converting the reinforcing fiber sheet 1 into a fiber-reinforced composite material.

According to the results of an experiment carried out by the present inventors, it is necessary that the total cross-sectional area ($S_R$) and modulus of elasticity ($E_R$) Of the reinforcing fiber satisfy the following relational formula relative to the total cross-sectional area ($S_S$) and modulus of elasticity ($E_S$) of the reinforcing bar 10 in the axial direction of the concrete pole 9:

$$0.06<E_R \cdot S_R/E_S \cdot S_S<3.0.$$

It is necessary to satisfy the formula in order to provide the concrete pole 9 with elasticity up to an elongation exceeding the elongation causing plastic deformation of the reinforcing bar 10. Elasticity is provided through reinforcement by means of the reinforcing layer 11 made of a fiber-reinforced composite material.

A relation $E_R \cdot S_R/E_S \cdot S_S \leqq 0.06$ leads only to a slight restoration force of the concrete pole 9, so that the concrete pole 9 can not resume the original shape. The pole would have a residual permanent deflection. A relation $E_R \cdot S_R/E_S \cdot S_S \geqq 3.0$ results on the other hand, in an excessively high stiffness so that application of a large deflection causes the concrete pole 9 to fracture on the compression side.

The coverage of the reinforcing layer 11 of the fiber-reinforced composite material should extend, for example, to a depth of at least 30 cm and a height of at least 100 cm from the ground level of the concrete pole 9. This ensures that the concrete pole 9 has sufficient elasticity to resume its original shape upon a collision by a car. Needless to say, the reinforcing layer 11 may be provided over the entire pole length, considering the location of service of the concrete pole 9.

Needless to say, the reinforcing layer 11 of the fiber-reinforced composite material may be provided before or after installation of the concrete pole 9.

For the purpose of protecting the reinforcing layer 11 and preventing peel-off thereof, a second reinforcing layer similar to the reinforcing layer 11 and made of a similar fiber-reinforced composite material may be provided thereon such that the orientation of the reinforcing fibers of the second reinforcing layer coincides with the circumferential direction of the concrete pole 9.

In the present invention, as described above, the unidirectional reinforcing fiber sheet 1 formed by arranging reinforcing fibers 4 in one direction through an adhesive layer 3 on a substrate sheet 2 is used for providing the reinforcing layer 11 of the fiber-reinforced composite material on the concrete pole 9.

As for the substrate sheet 2 of this reinforcing fiber sheet 1, there may be used scrim cloth, glass cloth, mold release paper, nylon film and the like. When scrim cloth or glass cloth is used for the substrate sheet 2, the thermosetting resin can be impregnated from the side of the sheet 2 into the reinforcing fibers 4. To keep a level of flexibility and to permit support of the reinforcing fibers 4, the substrate sheet 2 should have a thickness within a range of from 1 to 500 μm, or more preferably, from 5 to 100 μm.

Any adhesive which can at least temporarily stick the reinforcing fibers 4 onto the substrate sheet 2 may in principle, be used for forming the adhesive layer 3. It is preferable to use a resin having a satisfactory affinity with a thermosetting resin. When an epoxy resin is used as the thermosetting resin, for example, it is recommended to use an epoxy type adhesive. Because the adhesive has to bond the reinforcing fibers 4 only temporarily, the thickness of the adhesive layer 3 should be within a range of from 1 to 500, μm, or more preferably, of from 10 to 30 μm.

The reinforcing fibers 4 arranged in one direction of the reinforcing fiber sheet 1 are provided on the substrate 2 by unidirectionally arranging fiber bundles each binding a plurality of filaments or bundles gathering slightly twisted filaments through the adhesive layer 3 onto the substrate sheet 2 and pressing them from above. Pressing of the fiber bundles slightly scatters the fiber bundles and the filaments thereof are stuck in one direction through the adhesive layer 3 onto the substrate sheet 2 in a state in which the filaments are laminated into a plurality of laminations through connection by a bundling agent or twisting. Thus, fiber sheet 1 is provided with the desired reinforcing.

At this point of the process, fiber bundles may be densely arranged close to each other or may be sparsely arranged at intervals. The filaments of a fiber bundle may or may not be opened. The degree of pressing depends upon the target thickness of the arranged reinforcing fibers 4. As an example, carbon fiber bundles, each containing about 12,000 filaments of a diameter of from 5 to 15, μm, should be pressed to cause the filaments to form a width of about 5 mm.

Applicable thermosetting resins for impregnation of the reinforcing fibers 4 include epoxy, unsaturated polyester, vinyl ester and urethane thermosetting resins. Particularly, a room-temperature setting type resin made to set at room temperature by adjusting the curing agent and/or the curing accelerator for the thermosetting resin is suitably applicable. When using an ordinary thermosetting resin, it is necessary to cure the thermosetting resin impregnating the reinforcing fibers through heating of the reinforcing fiber sheet wound on the concrete pole. It is, however, possible, when using a room-temperature setting resin, to cause curing of the thermosetting resin by leaving the reinforcing fiber sheet wound on the concrete pole after impregnation of reinforcing fibers with the resin. When providing a reinforcing layer of a fiber-reinforced composite material on an already installed concrete pole, operations may be carried out at a high efficiency.

Impregnation of the reinforcing fibers 4 with a thermosetting resin may be conducted before or after winding the reinforcing fiber sheet 1 onto the concrete pole. When the thermosetting resin is impregnated after winding, a resin-permeable sheet, such as scrim cloth or glass cloth, may be used as the substrate sheet 2 of the reinforcing fiber sheet 1, as described above.

According to the present invention, application of the reinforcing layer 11 of the fiber-reinforced composite material using the reinforcing fiber sheet 1, is effected as follows.

Figure 6:
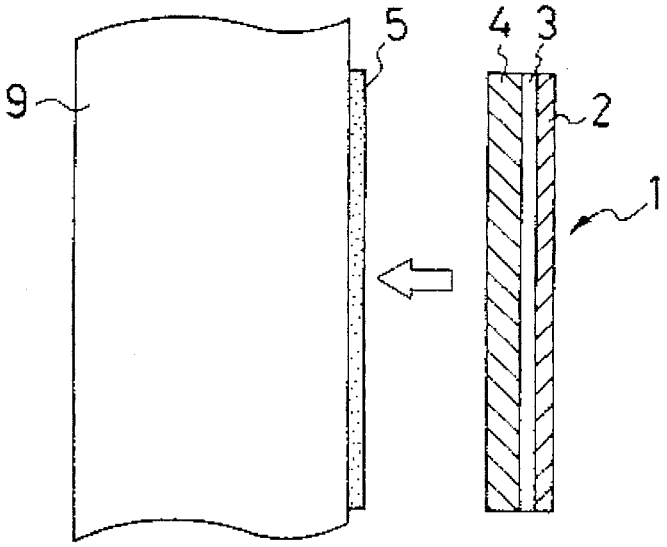
FIG. 6 is a sectional view illustrating a method of applying a reinforcing fiber sheet in the present invention.

As shown in FIG. 6, the process comprises the steps of applying a thermosetting resin 5 onto the surface of a desired portion of the concrete pole 9, centering around the ground level, having a thickness of, for example, about 100 μm; then winding one or more reinforcing fiber sheets 1 by aligning the direction of the reinforcing fibers 4 with the axial direction of the pole 9; and impregnating the reinforcing fibers 4 with the thermosetting resin 5 by pressing. When winding a second sheet 1 onto the already wound sheet 1, the thermosetting resin may be applied again onto the substrate sheet 2 of the first sheet 1. Then, after impregnating the thermosetting resin by a hand roller, for example, the sheets 1 are covered by a tape wound on the sheets 1. Subsequently, the thermosetting resin impregnating the reinforcing fibers 4 is cured by heating the reinforcing fiber sheet 1, or when using a room-temperature setting resin, by leaving the reinforcing fiber sheet 1 as is, to convert the reinforcing fiber sheet 1 into a fiber-reinforced composite material. In this way, the reinforcing layer 11, comprising the fiber-reinforced composite material, is applied onto the concrete pole 9.

Figure 7:
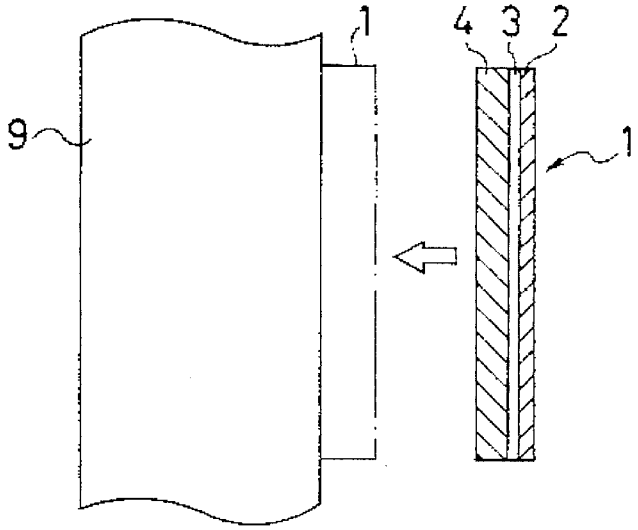
FIG. 7 is a sectional view illustrating another method of applying a reinforcing fiber sheet in the present invention.

An alternative process comprises the steps of impregnating, the reinforcing fibers 4 on the reinforcing fiber sheet 1 with the thermosetting resin by an appropriate applicating means, such as a roller, a brush or spraying; and then, as shown in FIG. 7, winding one or more reinforcing fiber sheets onto the surface of a desired portion of the pole 9 centering around the ground level with the reinforcing fibers 4 on the pole side while considering the direction of the reinforcing fibers 4. Subsequently, a covering coat is provided. The thermosetting resin is then cured converting the sheet 1 into a fiber-reinforced composite material.

Figure 8:
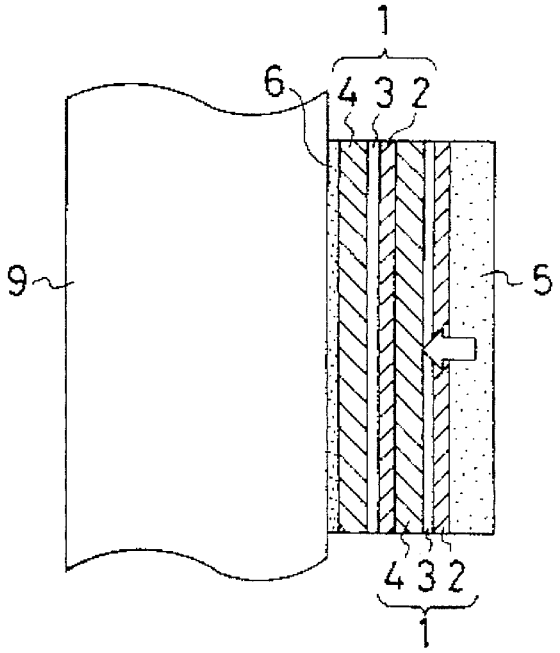
FIG. 8 is a sectional view illustrating further another method of applying a reinforcing fiber sheet in the present invention.

A further alternative process comprises the steps of applying the primer 6, which comprises a resin of the same type as the thermosetting resin, onto the surface of a desired portion of the concrete pole 9, as shown in FIG. 8; winding one or more reinforcing fiber sheets 1, having a resin-permeable substrate sheet 11 thereonto while considering the orientation of the reinforcing fibers 4; and then impregnating the thermosetting resin 5 onto the substrate sheet 2 of the outermost sheet 1 by means of a roller, for example. The subsequent steps are the same as above; namely, providing a cover coat and curing the thermosetting resin to convert the sheet 1 into a fiber-reinforced composite material.

In all of the above-mentioned embodiments, the reinforcing fiber sheet 1 is preferably wound with the reinforcing fibers 4 facing the concrete pole 9. However, it is also possible to form a reinforcing layer 11 of a fiber-reinforced composite resin material by winding the reinforcing fiber sheet 1 with the substrate sheet 2 facing the pole 9.

The above embodiments have covered the embodiment of an electric pole. However, the present invention is also applicable to a bridge pier, a post for an indication panel or a post for a signboard.

Some examples of the present invention are now described below.

Examples 1 to 5 and Comparative Examples 1 to 5

A reinforcing layer 11 of a fiber-reinforced composite material was formed to reinforce a concrete pole 9 by using a unidirectional reinforcing fiber sheet of various reinforcing fibers. A bending test was carried out in accordance with JIS-A5309.

The tested concrete pole was a straight cylindrical reinforced concrete pole of 10-35-N5000, i.e., having a length of 10 m, an outside diameter of 35 cm, and a design bending moment (M) of 5,000 kgm.

Figure 4:
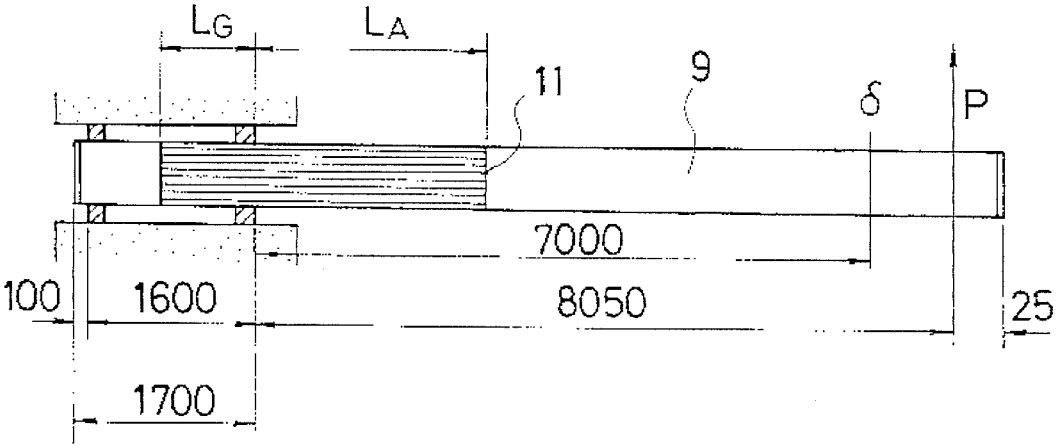
FIG. 4 is a plan view illustrating the test for investigating the reinforcing effect of the concrete pole of the present invention.

As shown in FIG. 4, the base end of the concrete pole 9 up to a position spaced 1.7 m from the base end (corresponding to the buried depth) was fixed. A load P was then applied by hooking a wire to the pole 9 spaced 8,050 mm from the fixed end to perform a cantilever bending test.

After deflecting the pole 9 until it displaces 400 mm, measured at a position 7 m from the fixed end, the load was removed to measure residual deflection at a position of 7 m. A residual deflection of up to 100 mm was determined to be a good result.

A reinforcing layer 11 of a fiber-reinforced composite material was formed by applying a reinforcing fiber sheet, impregnated with a thermosetting resin, around the concrete pole so that the reinforcing fibers were arranged in the longitudinal direction of the concrete pole 9, and then curing the resin. The fiber sheet was positioned on the concrete pole 9 so that the fixed end upon the test, 1.7 m from the base end and corresponding to the ground level, was located in between the edges of the fiber sheet.

The effects of the reinforcing fiber, the thickness of the reinforcement, the length of the reinforcement, and the residual deflection were determined.

Modulus of elasticity of reinforcing fiber:
$E_R$ in kgf/cm$^2$,

Total cross-sectional area of reinforcing fiber:
$S_R$ in cm$^2$

Modulus of elasticity of reinforcing bars used:
$E_S$ in kgf/cm$^2$ (up to 2,000,000 kgf/cm$^2$), Total cross-sectional area of reinforcing bars used:
$S_S$ in cm$^2$ (up to 6.4 cm$^2$).

The results were arranged in terms of the ratio $E_R \cdot S_R / E_S \cdot S_S$ on the assumption as described above.

The reinforcement covered a portion lower than the fixed end (depth), $L_G$, and a portion higher than the fixed point (height), $L_A$.

Details of Example 1 are as follows. A portion of a depth of 1 m and a height of 5 m from the fixed end position of the concrete pole was reinforced by the use of a unidirectional reinforcing fiber sheet of carbon fiber (carbon fiber sheet).

A "FORCA TOW SHEET FTS-Cl-17" manufactured by Tonen Co., Ltd. was used as the carbon fiber sheet, and "FR RESIN FR-E3P", an epoxy resin adhesive, manufactured by Tonen was used as the impregnating resin.

The procedure for application comprised the steps of preparing a mixture of the above-mentioned thermosetting resin and a curing agent mixed at a prescribed ratio, applying the resin mixture in an amount of about 500 g/m$^2$ to a portion of the concrete pole to be reinforced, then applying and impregnating the carbon fiber sheet with the resin mixture so that the fiber orientation was in alignment with the axial direction of the concrete pole, and making the sheet into a composite material by curing the thermosetting resin. One unidirectional carbon fiber sheet was applied.

After application, the reinforced concrete pole was maintained at a temperature of up to 20° C. for a week for curing, and then the above-mentioned bending test was carried out to measure residual deflection of the concrete pole.

$E_R$=2,350,000 kgf/cm$^2$, $S_R$=1.06 cm$^2$, $E_S$=2,000,000 kgf/cm$^2$, $S_S$=1.06 cm$^2$.

This resulted in: $E_R \cdot S_R/E_S \cdot S_S$=0.19. $L_G$=100 cm and $L_A$=500 cm.

The Examples 2 to 5 and the Comparative Examples 1 to 5 were also carried out as in the Example 1.

TABLE 1

| | Material | Laminations | $S_R$, cm$^2$ | $E_R$, kgf/cm$^2$ | $E_R \cdot S_R/E_S \cdot S_S$ | Reinforced range, cm $L_a$ | Reinforced range, cm $L_A$ | Residual deflection, mm | Deterimination |
|---|---|---|---|---|---|---|---|---|---|
| Example 1 | Carbon fiber FTS-C1-17 | 1 | 1.06 | 2,350,000 | 0.19 | 100 | 500 | 45 | O |
| Example 2 | Carbon fiber FTS-C1-17 | 1 | 1.06 | 2,350,000 | 0.19 | 35 | 500 | 65 | O |
| Example 3 | Carbon fiber FTS-C1-30 | 1 | 1.81 | 2,350,000 | 0.33 | 100 | 500 | 33 | O |
| Example 4 | Carbon fiber FTS-C5-30 | 1 | 1.81 | 3,800,000 | 0.54 | 100 | 500 | 21 | O |
| Example 5 | Carbon fiber FTS-CE-30 | 1 | 1.30 | 740,000 | 0.075 | 100 | 500 | 75 | O |
| Comparative Example 1 | Not reinforced | — | — | — | — | — | — | 185 | X |
| Comparative Example 2 | Carbon fiber FTS-C1-17 | 1 | 1.06 | 2,350,000 | 0.19 | 100 | 70 | 123 | X |
| Comparative Example 3 | Glass fiber plain-woven cloth, Unit weight = 200 g/m$^2$ | 2 | 9.86 | 749,000 | 0.050 | 100 | 500 | 128 | X |
| Comparative Example 4 | Carbon fiber FTS-C5-30 | 6 | 10.9 | 3,800,000 | 3.23 | 100 | 500 | Compression fracture at initial deflection of 350 mm | |
| Comparative Example 5 | Carbon fiber FTS-C1-17 | 1 | 1.06 | 2,350,000 | 0.19 | 20 | 500 | Sheet peel off at initial deflection of 380 mm | |

In each of the Examples 1 to 4, as shown in Table 1, a unidirectional reinforcing fiber sheet of carbon fiber was used, and in the Example 5, a unidirectional fiber sheet of glass fiber was used, to form the reinforcing layer of the fiber-reinforced composite material provided on the desired portion of the concrete pole at the ground level for reinforcement. There was only slight residual deflection in the concrete pole after the bending test, thus a good result was obtained in terms of improving the elasticity by reinforcement.

In contrast, in the Comparative Example 1, in which no reinforcement was applied; in the Comparative Example 2, in which the lower length of reinforcement, $L_G$, was small, and in the Comparative Example 3, in which a glass fiber plain-woven cloth was used and the ratio $E_R \cdot S_R/E_S \cdot S_S$ was lower than the range in the present invention, the concrete pole had a large residual deflection after the bending test and thus did not result in a satisfactory improvement of the elasticity of the pole 9. In the Comparative Example 4 in which a unidirectional carbon fiber sheet was used, having a ratio $E_R \cdot S_R/E_S \cdot S_S$ exceeding the range in the present invention, the concrete pole suffered from compression fracture with an initial deflection of 350 mm in the bending test. In the Comparative Example 5, in which a unidirectional carbon fiber sheet was used and, the upper distance of reinforcement, $L_A$, was small, the reinforcing layer peeled off with an initial deflection of 380 mm.

According to the present invention, as described above in detail, a portion of the outer circumference of the concrete pole which comprises reinforced concrete and has a substantially cylindrical shape, is reinforced by a reinforcing layer of a fiber-reinforced composite material. The reinforcing layer covers a depth of at least 30 cm and a height of at least 100 cm relative to the ground level when the concrete pole is placed in the ground. Reinforcing fibers of the reinforcing layer are arranged in the axial direction of the reinforced concrete, and the total cross-sectional area ($S_R$) and modulus of elasticity ($E_R$) of the reinforcing fiber of the reinforcing layer satisfy the following relational formula relative to the total cross-sectional area ($S_S$) and modulus of elasticity ($E_S$) of the reinforcing bar in the axial direction of the reinforced concrete:

$$0.06<E_R \cdot S_R/E_S \cdot S_S<3.0$$

Therefore, it is possible to reinforce the concrete pole with a simple construction that improves elasticity.

We claim:

1. A concrete pole comprising: reinforced concrete of a substantially cylindrical shape having reinforcing bars, part of the outer circumference of said concrete pole being reinforced by a reinforcing layer of a fiber-reinforced composite material composed of reinforcing fibers and a thermosetting resin impregnated in the reinforcing fibers; said reinforcing layer covering a depth of at least 30 cm and a height of at least 100 cm relative to the ground level upon placing said concrete pole in the ground; reinforcing fibers of said reinforcing layer being oriented in the axial direction of said reinforced concrete pole; and the total cross-sectional area ($S_R$) and modulus of elasticity ($E_R$) of the reinforcing fiber of said reinforcing layer satisfying the following relational formula relative to the total cross-sectional area ($S_S$) and modulus of elasticity ($E_S$) of the reinforcing bar in the axial direction of said reinforced concrete:

$$0.06<E_R \cdot S_R/E_S \cdot S_S<3.0.$$

2. A concrete pole as claimed in claim 1, wherein the reinforcing fiber of said reinforcing layer is a fiber selected from the group consisting of carbon fiber and glass fiber.

3. A concrete pole as claimed in claim 1 wherein the resin of said reinforcing layer is a resin selected from the group consisting of epoxy, unsaturated polyester, vinyl ester and urethane resins.

4. A concrete pole as claimed in claim 1 wherein said concrete pole is an electric pole, a bridge pier, a post for an indication panel, or a post for a signboard.

5. A method of reinforcing a concrete pole comprising the steps of:

providing a concrete pole;

providing a reinforcing layer of a fiber-reinforced composite material composed of reinforcing fibers and a thermosetting resin impregnated in the reinforcing fibers, on part of the outer circumference of the concrete pole; said concrete pole comprising reinforced concrete having a substantially cylindrical shape and having reinforcing bars, said reinforcing layer covers a depth of at least 30 cm and a height of at least 100 cm relative to the ground level upon placing said concrete pole in the ground; the reinforcing fibers of said reinforcing layer being oriented in the axial direction of said reinforced concrete; and the total cross-sectional area ($S_R$) and modulus of elasticity ($E_R$) of the reinforcing fiber of said reinforcing layer satisfying the following relational formula relative to the total cross-sectional area ($S_S$) and modulus of elasticity ($E_S$) of the reinforcing bar in the axial direction of said reinforced concrete:

$$0.06<E_R \cdot S_R/E_S \cdot S_S<3.0.$$

6. A method of reinforcing a concrete pole as claimed in claim 5, wherein said reinforcing layer is formed by impregnating a reinforcing fiber sheet with a thermosetting resin, which reinforcing fiber sheet is formed by arranging reinforcing fibers in one direction through an adhesive layer to a substrate, applying the reinforcing fiber sheet onto the outer circumference of the concrete pole, and then curing the resin.

7. A method of reinforcing a concrete pole as claimed in claim 5, wherein said reinforcing layer is formed by applying a reinforcing sheet, which is formed by arranging reinforcing fibers in one direction through an adhesive layer to a substrate, onto part of the outer circumference of said concrete pole, impregnating the reinforcing fiber sheet with a thermosetting resin, and then curing the resin.

8. A method of reinforcing a concrete pole as claimed in claim 5, wherein said reinforcing layer is formed by coating a thermosetting resin onto part of the outer circumference of said concrete pole, applying a reinforcing sheet, which is formed by arranging reinforcing fibers in one direction through an adhesive layer to a substrate, onto the resin coated circumference of the concrete pole, pressing and impregnating the reinforcing fiber sheet with the thermosetting resin, and then curing the resin.

9. A method of reinforcing a concrete pole as claimed in claim 5, wherein the reinforcing fiber of said reinforcing layer is selected from the group consisting of carbon fiber and glass fiber.

10. A method of reinforcing a concrete pole as claimed in claim 5, wherein the resin of said reinforcing layer is selected from the group consisting of epoxy, unsaturated polyester, vinyl ester and urethane resins.

11. A method of reinforcing a concrete pole as claimed in claim 5, wherein said concrete pole is an electric pole, a bridge part, a post for an indication panel, or a post for a signboard.

* * * * *